US008033042B2

(12) United States Patent
Haraldsson et al.

(10) Patent No.: US 8,033,042 B2
(45) Date of Patent: Oct. 11, 2011

(54) FASTENING DEVICE FOR A BINDER

(75) Inventors: Tage Haraldsson, Smålandsstenar (SE); Tore Haraldsson, Smålandsstenar (SE)

(73) Assignee: KEBA Sweden AB, Smålandsstenar (SE)

( * ) Notice: Subject to any disclaimer, the term of this patent is extended or adjusted under 35 U.S.C. 154(b) by 483 days.

(21) Appl. No.: 12/333,528

(22) Filed: Dec. 12, 2008

(65) Prior Publication Data

US 2009/0152862 A1 Jun. 18, 2009

(30) Foreign Application Priority Data

Dec. 12, 2007 (SE) ..... 0702754

(51) Int. Cl.
*G09F 3/18* (2006.01)

(52) U.S. Cl. ..... 40/651; 40/649; 40/654.01; 40/661; 402/3; 283/81

(58) Field of Classification Search ..... 40/649, 40/650, 651, 653, 654.01, 661, 662; 402/3; 283/81

See application file for complete search history.

(56) References Cited

U.S. PATENT DOCUMENTS

| | | | | | |
|---|---|---|---|---|---|
| 1,598,206 | A * | 8/1926 | Lindstedt et al. | ..... | 402/3 |
| 1,865,741 | A * | 7/1932 | Carney | ..... | 402/3 |
| 2,977,698 | A * | 4/1961 | Chamberlin | ..... | 40/651 |
| 3,066,680 | A * | 12/1962 | Duncan | ..... | 402/3 |
| 3,335,508 | A * | 8/1967 | Hummel | ..... | 40/650 |
| 3,807,883 | A * | 4/1974 | Karlsson | ..... | 402/3 |
| 4,190,374 | A * | 2/1980 | Lindell | ..... | 402/3 |
| 6,019,540 | A * | 2/2000 | Senior | ..... | 283/81 |
| 6,357,154 | B1 * | 3/2002 | Pfendler et al. | ..... | 40/661.03 |

* cited by examiner

*Primary Examiner* — Gary Hoge
(74) *Attorney, Agent, or Firm* — Potomac Patent Group PLLC

(57) ABSTRACT

A device for fastening labels to binders which exhibit slots arranged in pairs at a mutual distance from each other for receiving end sections of label holders, and for firmly locking the end sections in the slots. The label holder is pocket-shaped, is flexible, and exhibits rows of recesses along lateral edge sections opposing each other. Hook-shaped locking elements distributed in rows are received inside the slots. The row of recesses and locking forms formed are adapted to each other in terms of shape for lockable receiving, interacting in pairs, of the respective locking elements in a suitable recess after insertion of the respective label end sections in a suitable slot.

16 Claims, 7 Drawing Sheets

FASTENING DEVICE FOR A BINDER

The present invention relates to a device for fastening a label to a binder which exhibits slots arranged in pairs at a mutual distance from each other for receiving end sections of label holders, and locking the same firmly therein.

BACKGROUND

This application claims priority from Sweden Application No. 0702754-3 filed on Dec. 12, 2007, which is incorporated here by reference.

There are many different devices for carrying labels on binder spines. Normal such devices are riveted pocket-shaped plastic pockets in which loose labels containing different information can be inserted. It sometimes happens that such label pockets loosen from the binder and the binder is then destroyed and must be scrapped, since no further on information is available on the content of the binder. Metal rivets suffer from the drawback that that they are able to soil adjacent binders, desks or any other object against which the binder is in contact. This applies particularly if the metal consists of aluminium, which blackens adjacent objects.

Other solutions are rigid, transparent plastic discs arranged so that can be inserted, with the respective angled edges, in suitable slotted recesses on the side of the binder, thereby retaining it in position with a receivable information label inside the same. These label holders risk being damaged or loosening easily from the binder by catching, or when the binder is opened. The action of sunlight may also impair its durability and fastening capacity.

SUMMARY

The principal object of the present invention is therefore primarily to solve the above-mentioned problems, among other things, by means of simple means that operate satisfactorily.

The object is achieved by means of a device according to the present invention, which is characterised mainly in that the pocket-shaped label holder is flexible and exhibits recesses in rows along opposing lateral edge sections, in that hook-shaped locking elements distributed in rows are received inside the slots, the row of recesses and row of locking elements being adapted to each other in terms of shape for the lockable receiving, interacting in pairs, of the individual locking elements in a suitable recess after insertion of the respective label lateral edge sections in suitable slots.

BRIEF DESCRIPTION OF THE DRAWINGS

The invention is described below as a preferred embodiment of the invention, reference being made to the attached drawings, in which.

DETAILED DESCRIPTION

Figure 1:
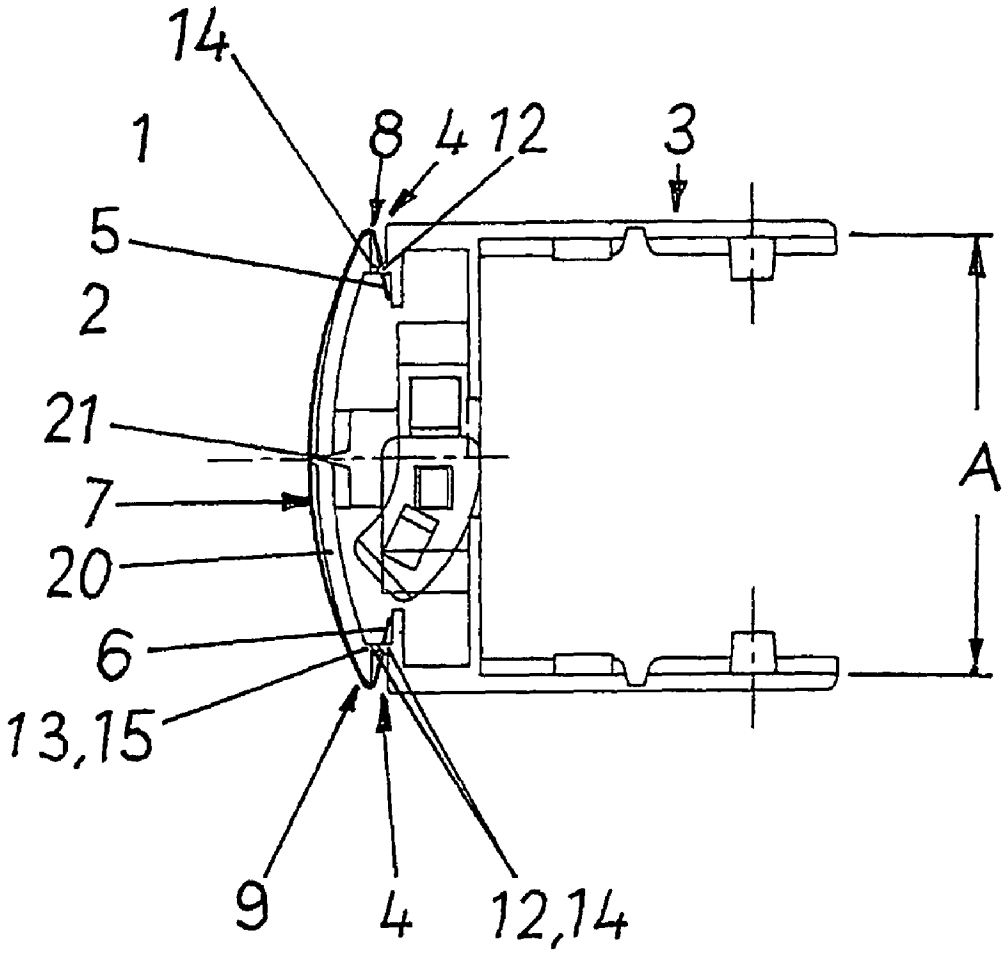
FIG. 1 shows, in cross-section, a binder side with the label fastening device in the active position.
Figure 2:
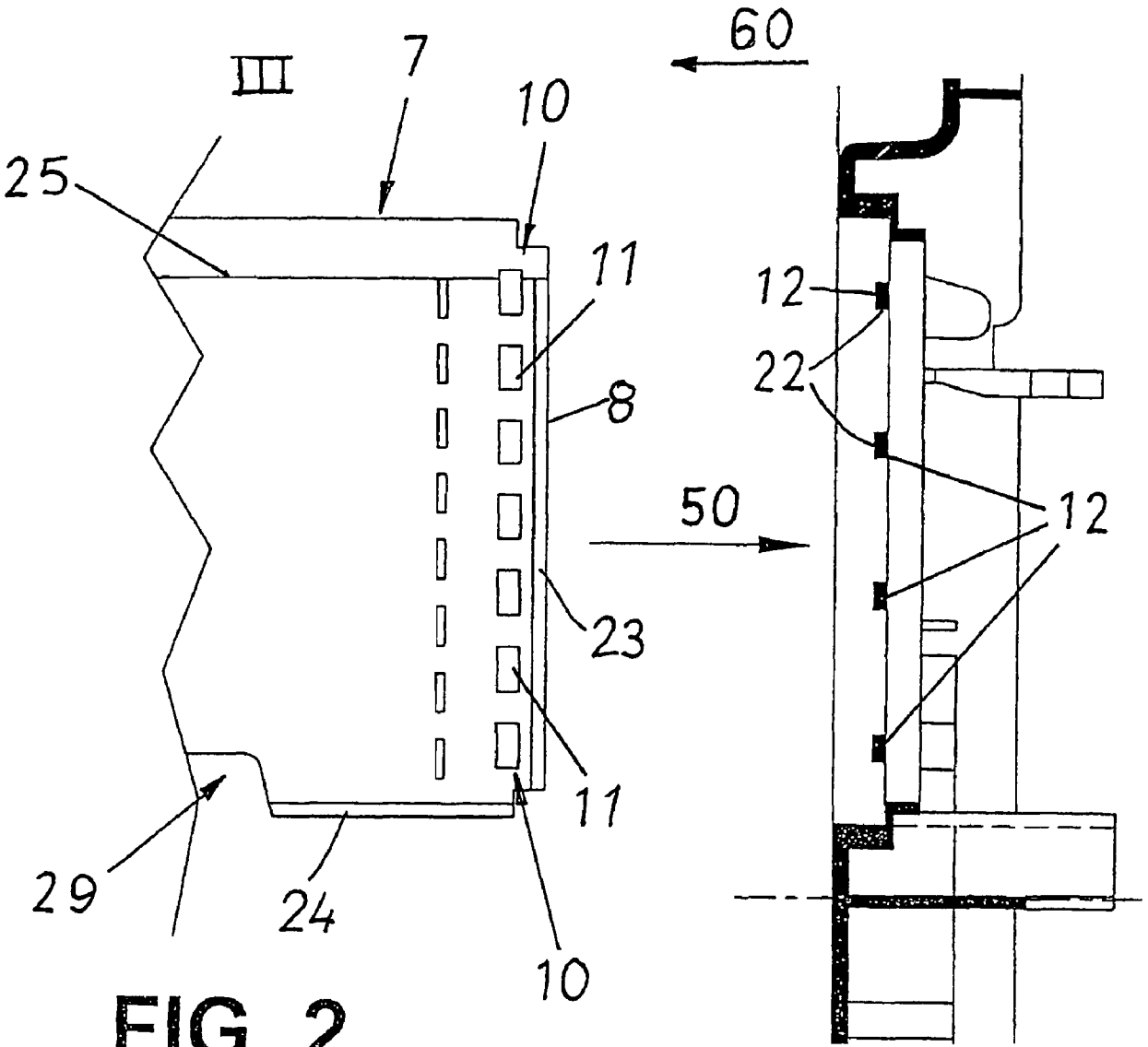
FIG. 2 shows an initial stage of a label fastening to a binder.
Figure 3:
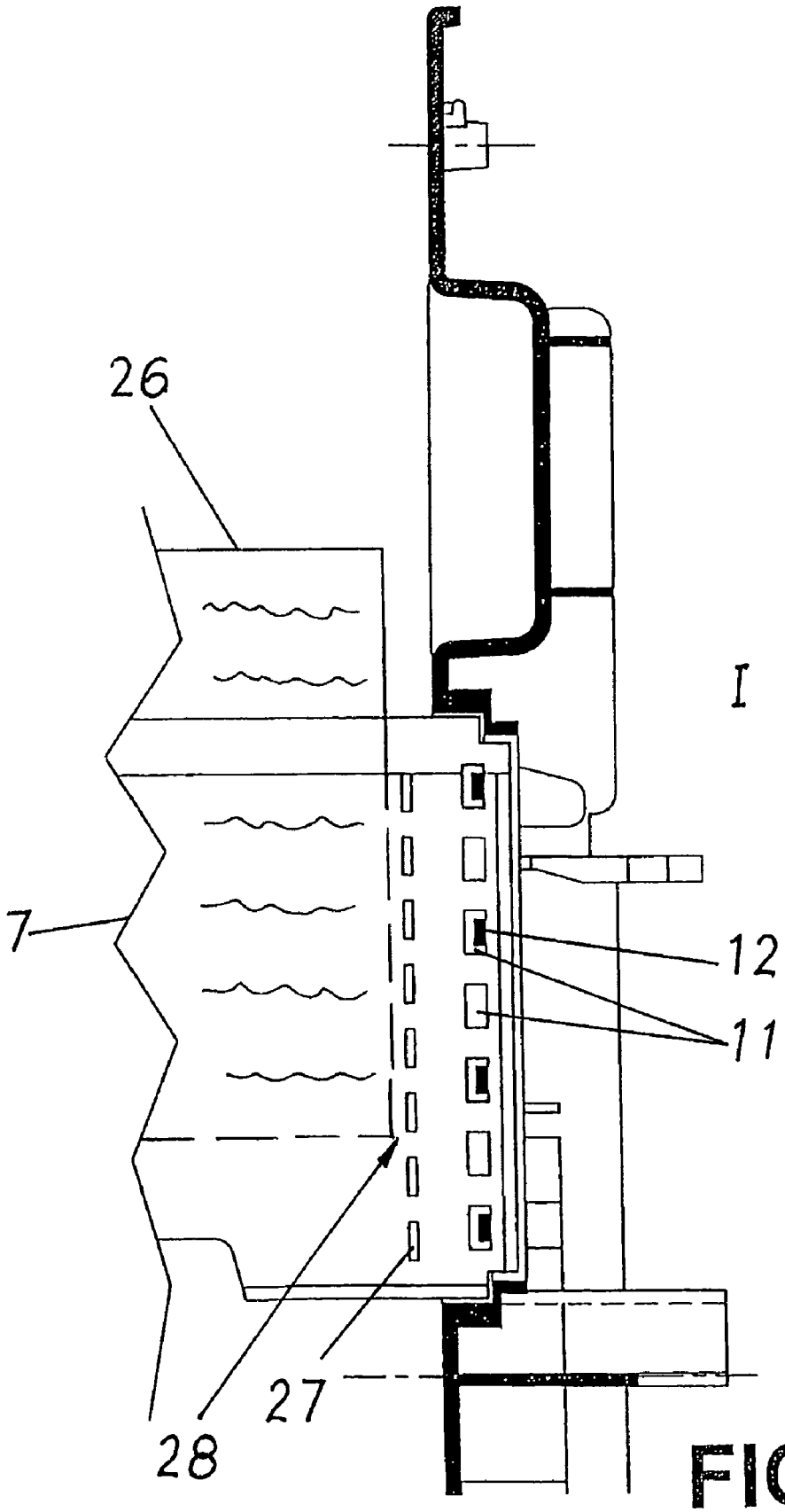
FIG. 3 shows a cross-section of a label fastened to a binder.
Figure 4:
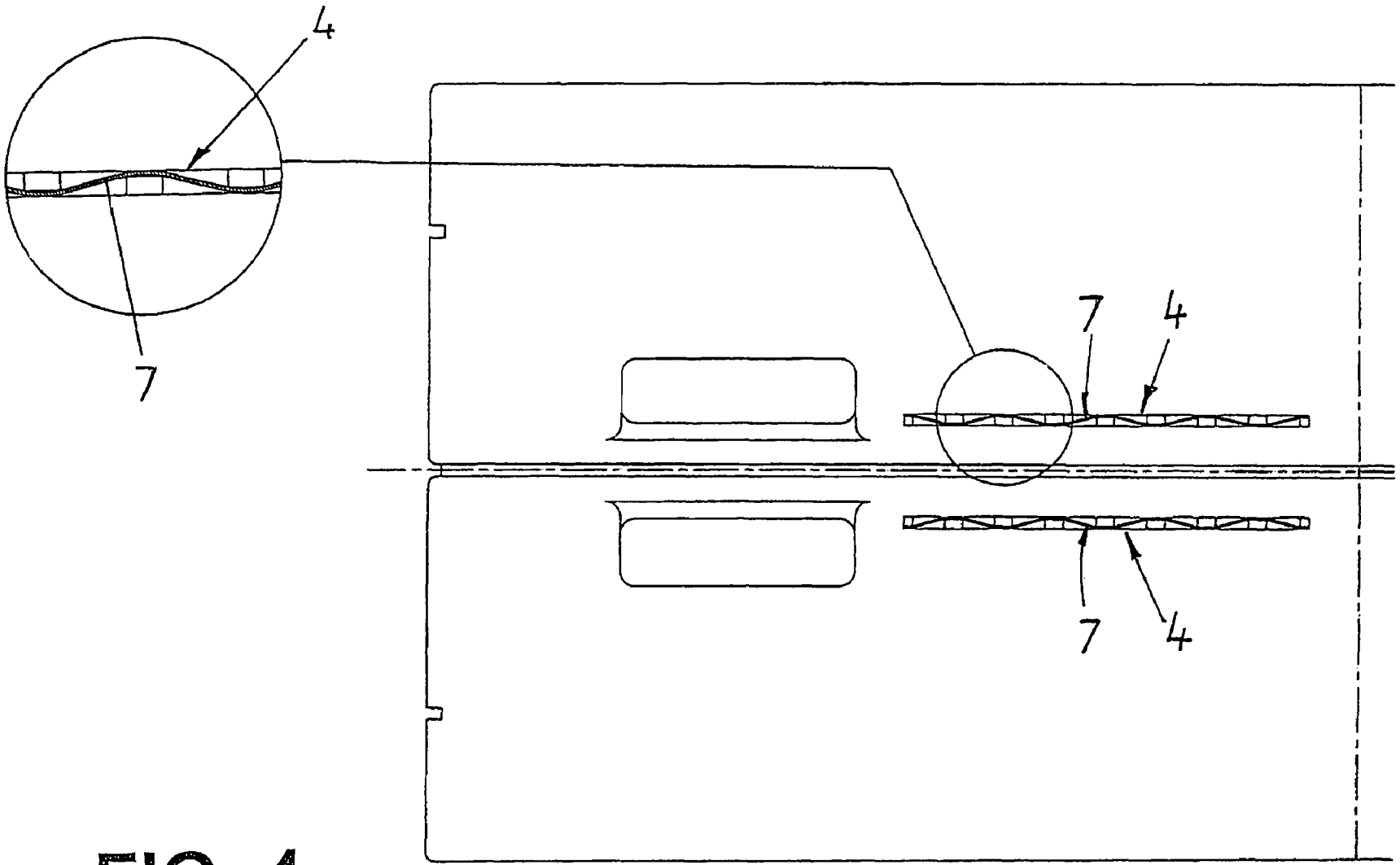
FIG. 4 shows part of a fully folded up binder side with partially encircled label receiving slots.
Figure 5:
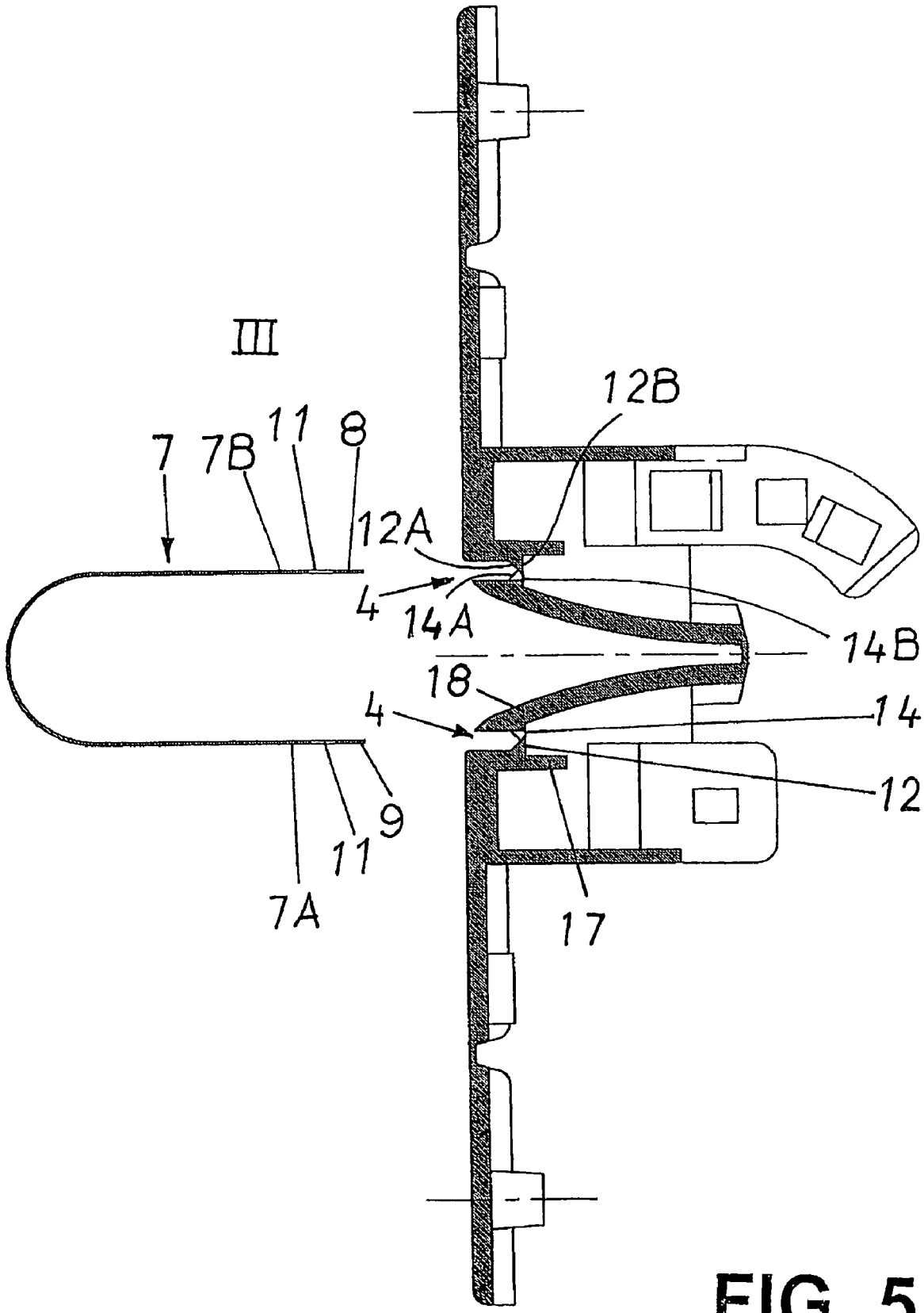
FIGS. 5, 6, and 7 show cross-sections of a binder side and a label fastening device in different fastening stages I, II, III.
Figure 6:
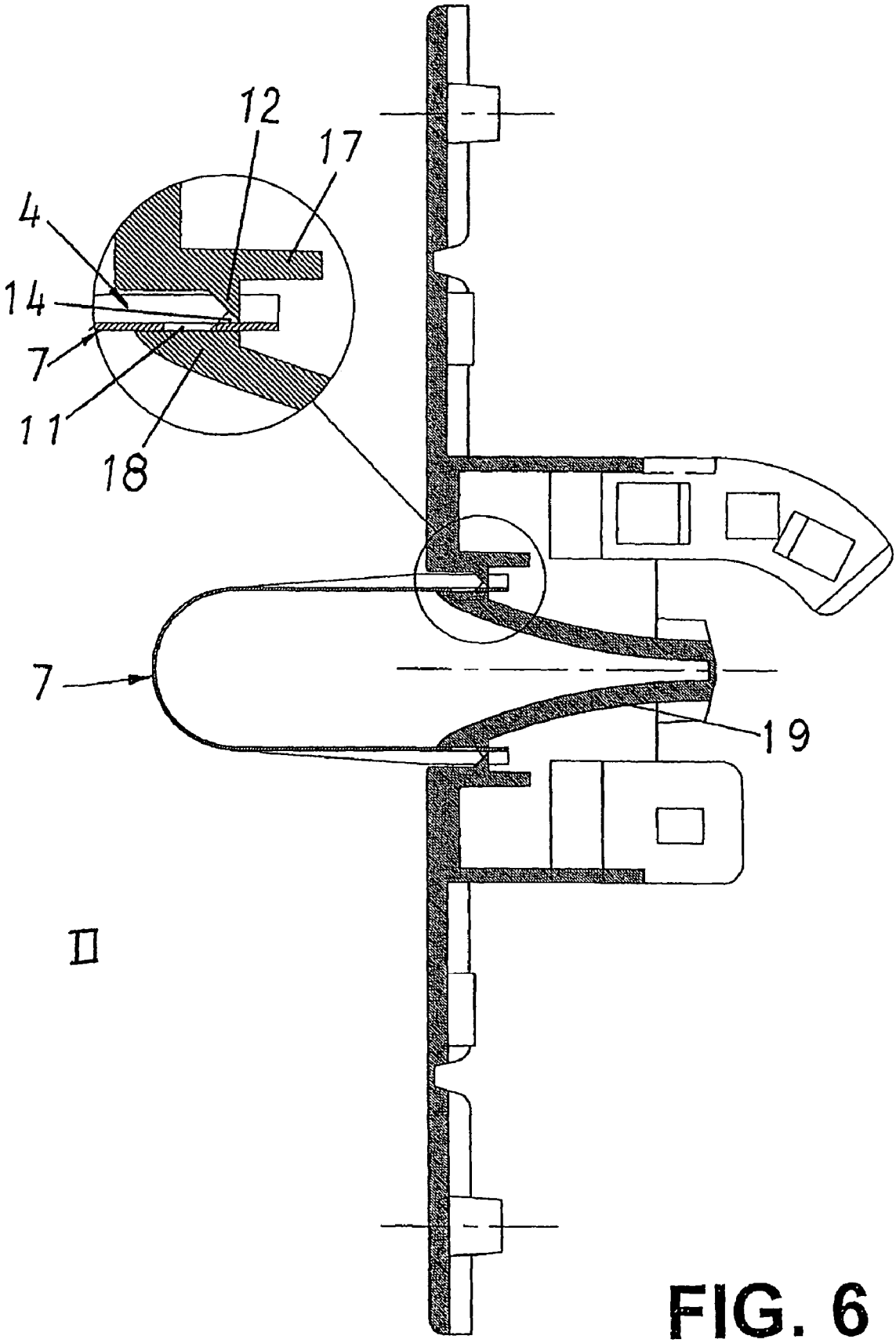

A device 1 constructed according to the present invention, which is designed for fastening labels 2 to binders 3 which are provided with slots 4 arranged in pairs at a mutual distance A from each other for receiving end sections 5, 6 of label holder 7, and locking the label holder 7 firmly therein, incorporates a pocket-shaped label holder 7, which is flexible and which exhibits recesses 11, arranged in rows 10, along lateral edge sections 8, 9 opposing each other. Hook-shaped locking elements 12, 14 distributed in rows 13, 15 are received inside the slots 4. In this case row 10, with recesses 11 and the row formed, 13, 15, with locking elements 12, 14, are adapted to each other in pairs, in terms of shape, for receiving respective locking elements 12, 14 in a suitable recess 11, lockably interacting in pairs, after insertion of the respective lateral label edge sections 8, 9 in a suitable slot 4.

The hook-shaped locking elements 12, 14 exhibit a shape that inclines from one side 12A, 14A of the same, and from the other side 12B, 14B a transverse shape or shape inclined in the opposite direction, when label holder 7 provided with a recess is inserted, pass in one direction 50, but continue to retain label holder 7 in the opposite direction 60.

According to the invention hook-shaped locking elements 12, 14 are alternately located on the laterally located walls 17, 18 of the slots, wherein one wall 18 is essentially parallel to the rear angled side section 19 of the folding side 20 of the binder, whose weakened central section 21 forms folding elements for the side 20. The other wall 17 is formed by a laterally displaced parallel angled part.

In each locking row 13, 15 are located at least three locking elements 12 and 14 respectively on either side of the slot 4.

The locking elements 12, 14 preferably exhibit straight locking edges 22 so that the locking is rendered distinct and equal along its entire height and width.

Label holders 7 are in turn formed by transparent plastic material, which can be produced in long lines by welding plastic films and punching to the desired shape. They can be provided with square-shaped recesses 11 in rows 10 along sealed lateral edges 23 and with transverse bottom sealing 24, and with opening 25 located at the top for insertion of a written or printed cardboard label 26, etc. for the binder 3 in question.

Along the rows 10, with recesses 11, the label holders 7 exhibit connections 27, e.g. welds in the form of rows 28. These are designed to form guides for inserting label 26 in label holder 7. For simple changing of label 26 on binder 3, label holder 7 exhibits bottom recess 29, which opposes insertion opening 25 of the respective label holders and is located in the centre of label holder 7.

Figure 7:
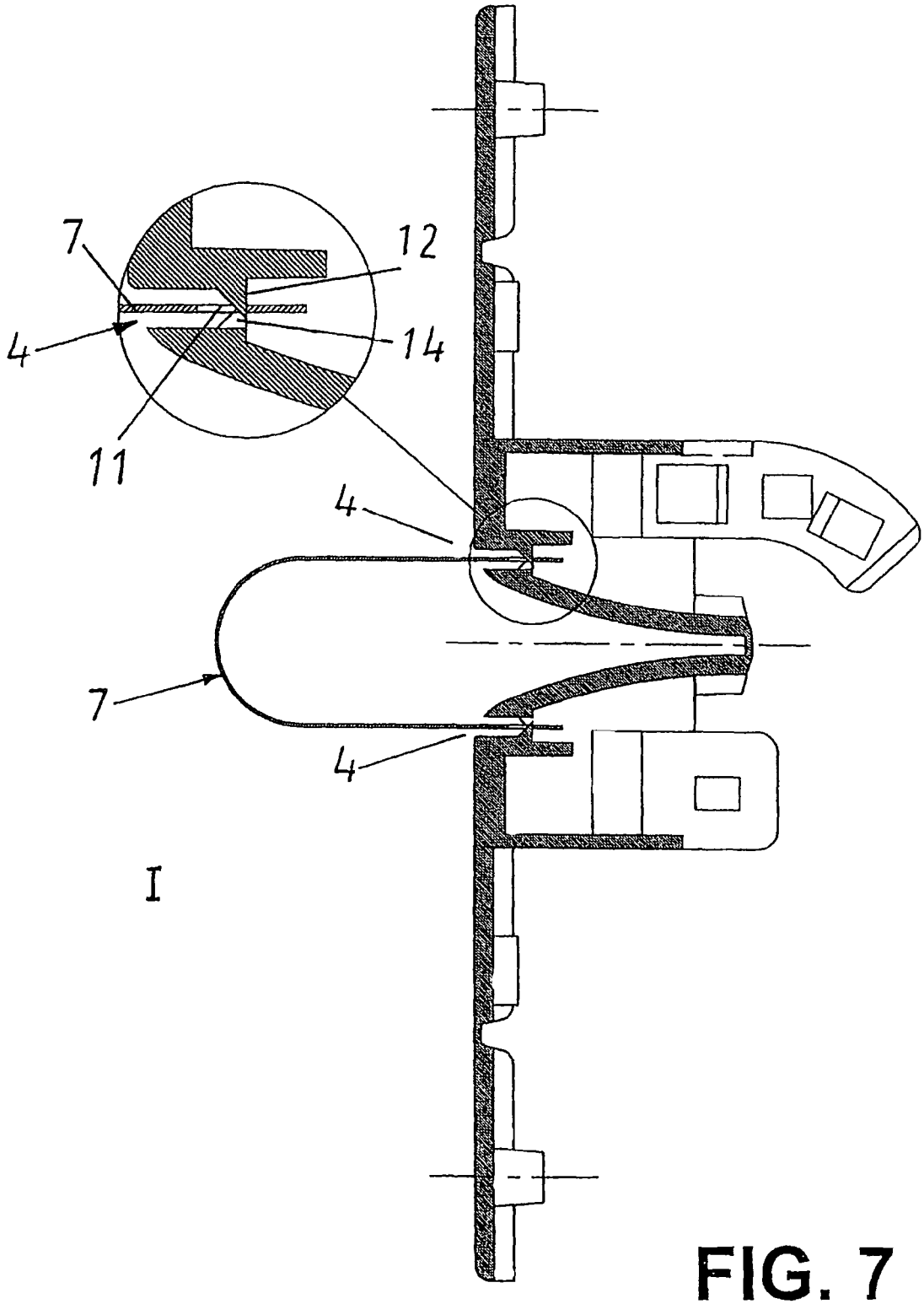

When pile 3 is folded fully up, as shown in FIG. 7, for example, label holder 7 is foldable either with or against folding element 21 of the binder spine provided with central elements.

The design and operation of the invention should be clearly evident from the above description and from what is shown in the drawings.

The method for fastening label holder 7 can be clearly understood on the basis of drawing FIGS. 2-3 and 5-7. The insertion of label holder 7 and its respective lateral sections 7A, 7B is kept in the fully folded-up position with binder spine side 20 in the position such as that shown in FIGS. 5-7. Locking elements 12, 14, distributed alternately in the vertical direction, are received by suitable recess 11 in the label holder, so that locking elements 12, 14 in fastening position I cross each other, viewed in the vertical direction, i.e. locking elements 12, 14 in a row are distributed 12, 14, 12, 14, etc. in the example shown, where seven rectangular recesses 11 are arranged. If a label is required to be replaced, the old one is poked through recess 29 in the bottom of label holder 11, but if label holder 11 is required to be changed, the old one must first be pulled off.

The invention is not of course limited to the embodiments described above and shown in the attached drawings. Modifications are possible, particularly in terms of the design of the different parts, or by using an equivalent method, without departing from the protective scope of the invention, as defined in the patent claims.

What is claimed is:

1. A device for fastening a label to a binder that exhibit slots arranged in pairs at a mutual distance from each other for receiving end sections of a label holder, and the firm locking of the same therein, wherein the label holder is pocket-shaped and flexible, and exhibits along opposing lateral edge sections recesses arranged in rows; hook-shaped locking elements are distributed in rows and insertable in the slots, whereupon a recess row formed and the row of locking elements are adapted to each other in terms of shape for the lockably receiving, interacting in pairs, of each locking element in a recess after insertion of the respective lateral label edge sections in a slot; the hook-shaped locking elements exhibit a shape inclined from one side, and a shape that is inclined in a transverse or opposing direction, so that when the label holder provided with recesses is inserted, they pass through in one direction but continue to retain the label holder in the opposite direction.

2. The device of claim 1, wherein the hook-shaped locking elements are arranged alternately, viewed along the row of locking elements formed.

3. The device of claim 1, wherein at least three locking elements are located on either side of a slot.

4. The device of claim 1, wherein the locking elements exhibit straight locking edges.

5. The device of claim 1, wherein the label holder is a transparent plastic material having rows of square-shaped recesses along sealed lateral edges, a transverse bottom seal, and an opening located at the top.

6. The device of claim 5, wherein along the recess rows the label holders exhibit connections.

7. The device of claim 5, wherein the bottom seal exhibits a recess arranged in the opposite direction to the insertion opening of the label holder.

8. The device of claim 6, wherein the bottom seal exhibits a recess arranged in the opposite direction to the insertion opening of the label holder.

9. The device of claim 1, wherein the hook-shaped locking elements are located on walls of the slots located laterally relative to each other.

10. The device of claim 9, wherein the hook-shaped locking elements are arranged alternately, viewed along the row of locking elements formed.

11. The device of claim 9, wherein at least three locking elements are located on either side of a slot.

12. The device of claim 9, wherein the locking elements exhibit straight locking edges.

13. The device of claim 9, wherein the label holder is a transparent plastic material having rows of square-shaped recesses along sealed lateral edges, a transverse bottom seal, and an opening located at the top.

14. The device of claim 13, wherein along the recess rows the label holders exhibit connections.

15. The device of claim 13, wherein the bottom seal exhibits a recess arranged in the opposite direction to the insertion opening of the label holder.

16. The device of claim 9, wherein the label holder is foldable with or against folding of a binder spine provided with central elements when the binder is folded fully upwards.

* * * * *